US008350193B2

(12) United States Patent
Lu

(10) Patent No.: US 8,350,193 B2
(45) Date of Patent: Jan. 8, 2013

(54) OIL WATER MIXTURE HEATING APPARATUS

(76) Inventor: Feng-Hui Lu, Kaohsiung (TW)

( * ) Notice: Subject to any disclaimer, the term of this patent is extended or adjusted under 35 U.S.C. 154(b) by 106 days.

(21) Appl. No.: 12/913,905

(22) Filed: Oct. 28, 2010

(65) Prior Publication Data

US 2012/0103968 A1 May 3, 2012

(51) Int. Cl.
*F27D 11/00* (2006.01)

(52) U.S. Cl. ..... 219/429; 392/479; 392/480; 392/481

(58) Field of Classification Search ..... 219/429, 219/534, 535; 392/478–503
See application file for complete search history.

(56) References Cited

U.S. PATENT DOCUMENTS

| | | | | |
|---|---|---|---|---|
| 2,873,098 | A * | 2/1959 | Morgan | 165/159 |
| 3,096,426 | A * | 7/1963 | Axelson | 392/495 |
| 3,523,178 | A * | 8/1970 | Drwal et al. | 392/451 |
| 3,835,294 | A * | 9/1974 | Krohn et al. | 392/484 |
| 4,286,140 | A * | 8/1981 | Dewulf et al. | 392/493 |
| 4,602,145 | A * | 7/1986 | Roberts | 392/496 |
| 4,866,250 | A * | 9/1989 | Pasbrig | 392/479 |
| 6,915,070 | B1 * | 7/2005 | Lee | 392/481 |
| 7,286,752 | B2 * | 10/2007 | Gourand | 392/479 |

FOREIGN PATENT DOCUMENTS

JP 2009250574 A * 10/2009

* cited by examiner

*Primary Examiner* — Henry Yuen
*Assistant Examiner* — John Wasaff
(74) *Attorney, Agent, or Firm* — Muncy, Geissler, Olds & Lowe, PLLC

(57) ABSTRACT

An oil water mixture heating apparatus comprises a metal outer barrel with a helical trough formed inside, a metal inner barrel held in the metal outer barrel to form a helical passage with the helical trough, a first and a second guide cap coupled on two sides of the metal outer and inner barrels, a first and a second seal cap coupled respectively on the first and second guide caps, a first and a second holder fixedly located on outer sides of the two seal caps and an electric heater encasing the metal outer barrel. When combustible oil or oil water mixture enters the helical passage and are heated by the electric heater, the oil or oil water mixture also is constantly blended in the helical passage so that it is heated rapidly to a required temperature and forms a finer oil water mixture.

6 Claims, 7 Drawing Sheets

OIL WATER MIXTURE HEATING APPARATUS

FIELD OF THE INVENTION

The present invention relates to an oil water mixture heating apparatus to facilitate rapid heating of combustible oil or oil water mixture to accelerate heating and save electric power.

BACKGROUND OF THE INVENTION

FIGS. 1 and 2 show a heating apparatus 1 for oil water mixture combustion systems to heat oil or oil water mixture.

The heating apparatus 1 comprises a barrel 11, a metal tube coil 12 and an electric heater 13. The metal tube coil 12 winds helically on the barrel 11, and the electric heater 13 encases the metal tube coil 12 to provide overall heating. The metal tube coil 12 consists of metal tubes 121 that form point contact between each other. And the electric heater 13 and the metal tube coil 12 also form point contact mutually. Hence there are gaps 14 and 15 formed between the barrel 11, electric heater 13 and the metal tubes 121 that become heat dissipation spaces, and the contact area of the electric heater 13 is smaller during heating and heat transfer speed is slower, and a longer time is needed for heating to reach a required temperature. There is still room for improvement.

SUMMARY OF THE INVENTION

The primary object of the present invention is to provide an oil water mixture heating apparatus to overcome the shortcomings of the aforesaid heating apparatus that form point contact between the electric heater and metal tube coil, and between the metal tubes of the metal tube coil that result in a smaller contact area in heating and slower heating speed.

To achieve the foregoing object the oil water mixture heating apparatus according to the present invention includes a metal outer barrel containing a helical trough, a metal inner barrel held inside the metal outer barrel to form a helical passage with the helical trough, a first guide cap and a second guide cap coupled on two sides of the metal inner and outer barrels, a first seal cap and a second seal cap coupled respectively on the first and second guide caps, a first holder and a second holder to hold the first and second seal caps at the outer sides, and an electric heater encasing the metal outer barrel. The helical passage formed by the helical trough between the metal inner barrel and outer barrel, and the electric heater and the encased metal outer barrel form a surface contact between them, thus can speed up heat absorption and transfer so that oil or oil water mixture passing through the helical passage gets a greater contact area during heating and can be heated faster.

Through the aforesaid technique the present invention can provide many benefits, notably:

1. Oil or oil water mixture can be heated faster and temperature control is more accurate to save electric power.

2. The oil water mixture passes through the helical passage during heating, a continuous mixing process also takes place to form finer oil water mixture, thus can accelerate heating, reduce electric power consumption and save energy.

The foregoing, as well as additional objects, features and advantages of the present invention will be more readily apparent from the following detailed description, which proceeds with reference to the accompanying drawings.

DETAILED DESCRIPTION OF THE PREFERRED EMBODIMENTS

Figure 1:
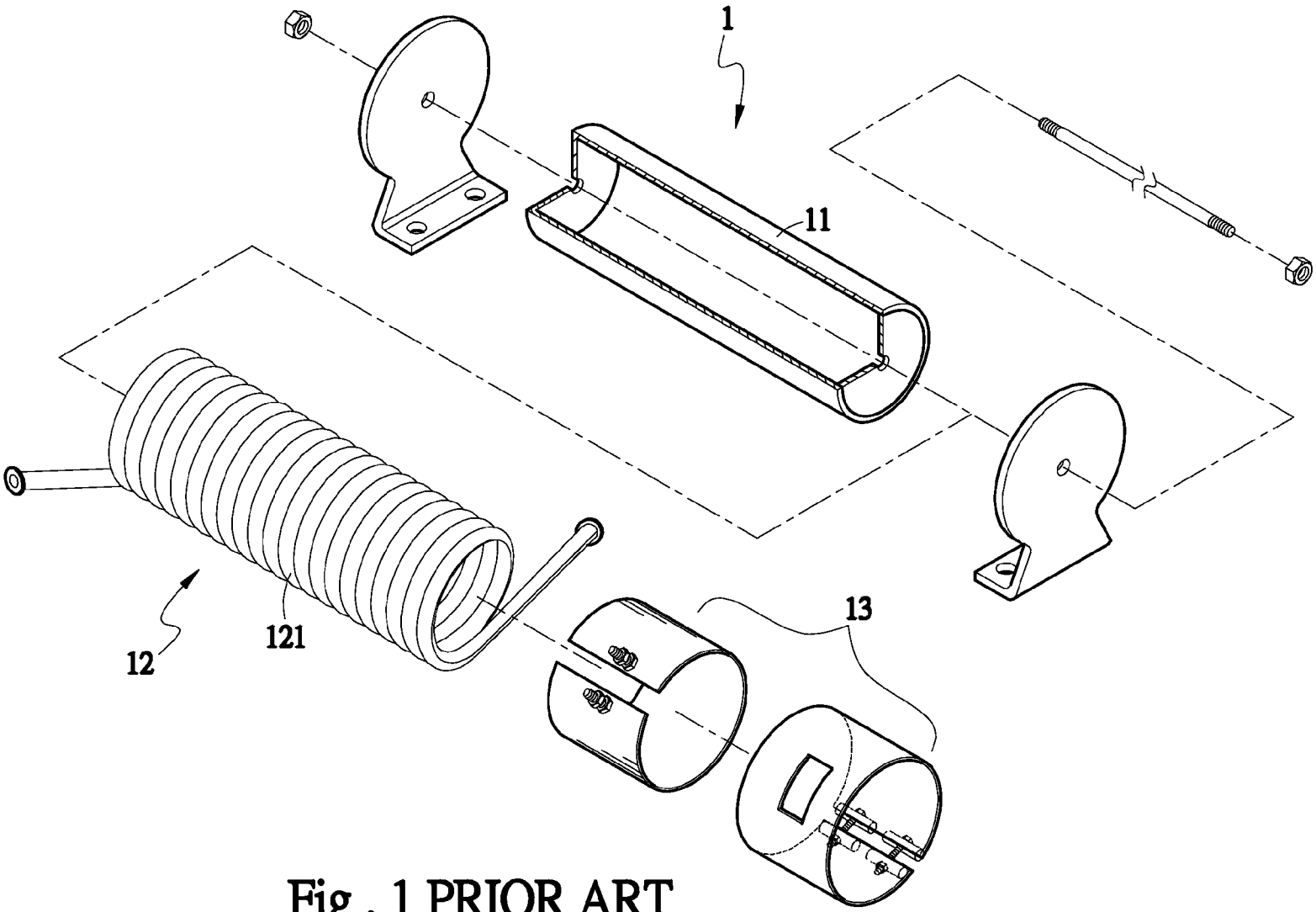
Fig. 1 PRIOR ART
FIG. 1 is an exploded perspective view of a conventional oil water mixture heating apparatus.
Figure 2:
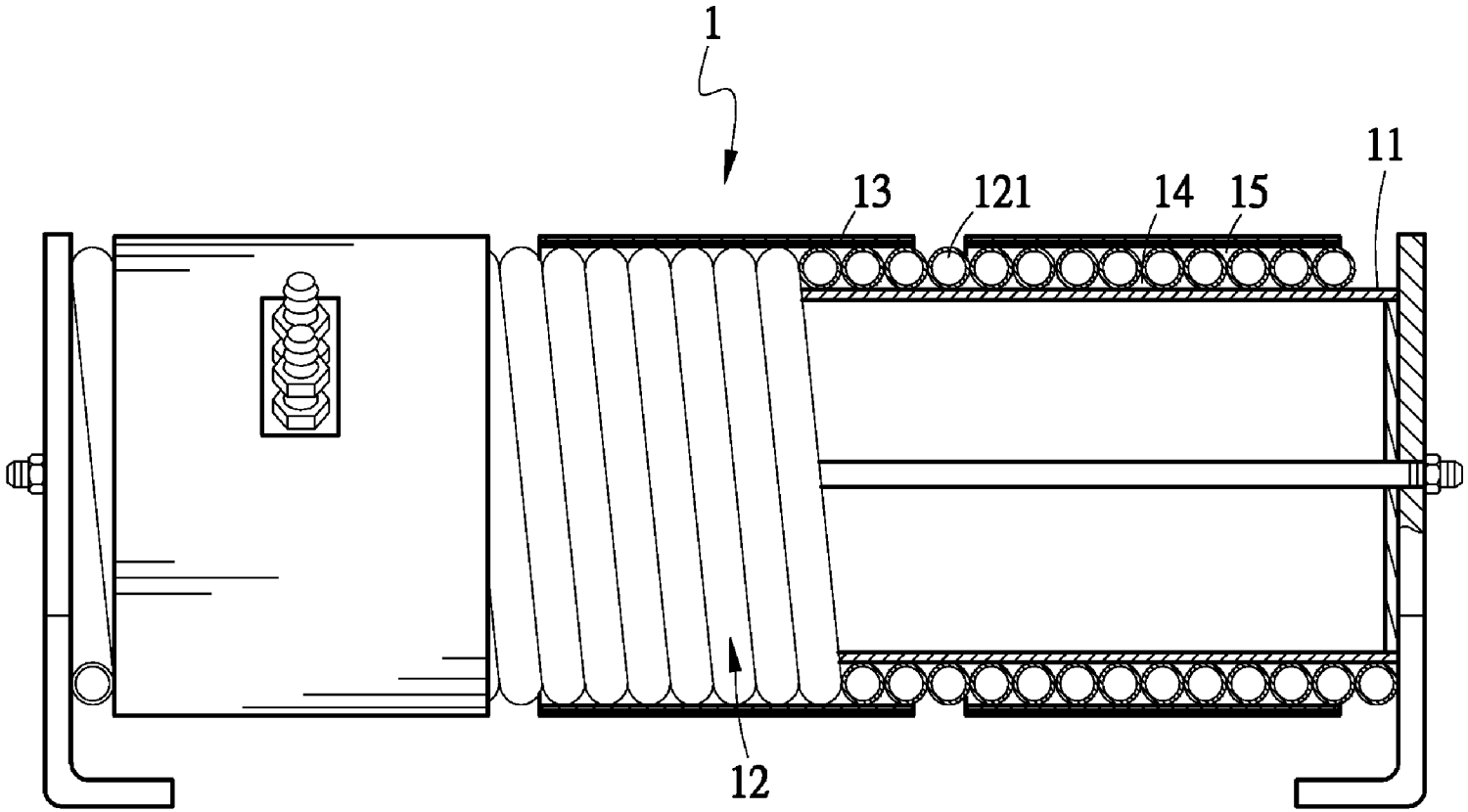
Fig. 2 PRIOR ART
FIG. 2 is a cross sectional view of the heating apparatus according to FIG. 1.
Figure 3:
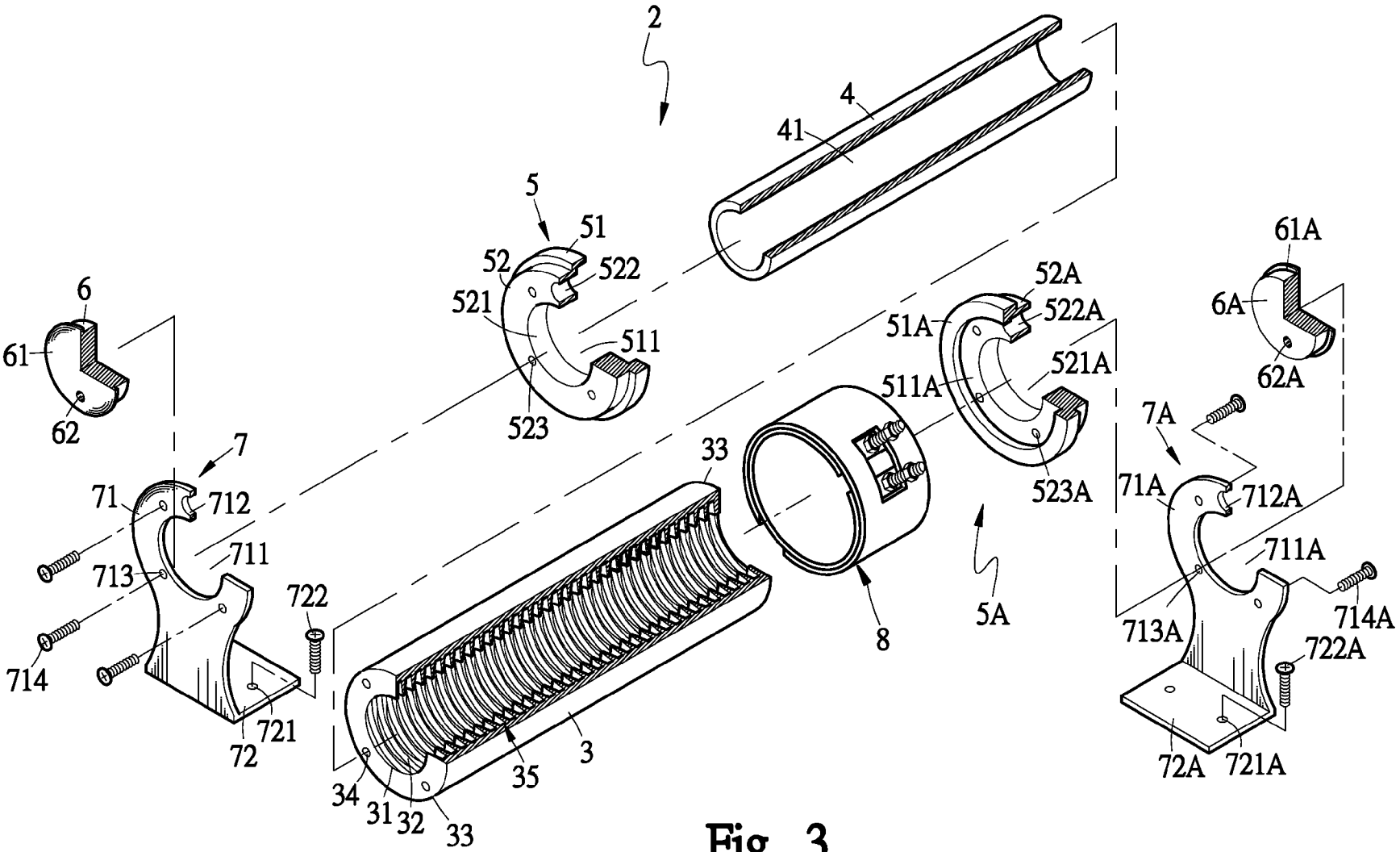
FIG. 3 is an exploded perspective view with partial cross section of the heating apparatus of the present invention.
Figure 4:
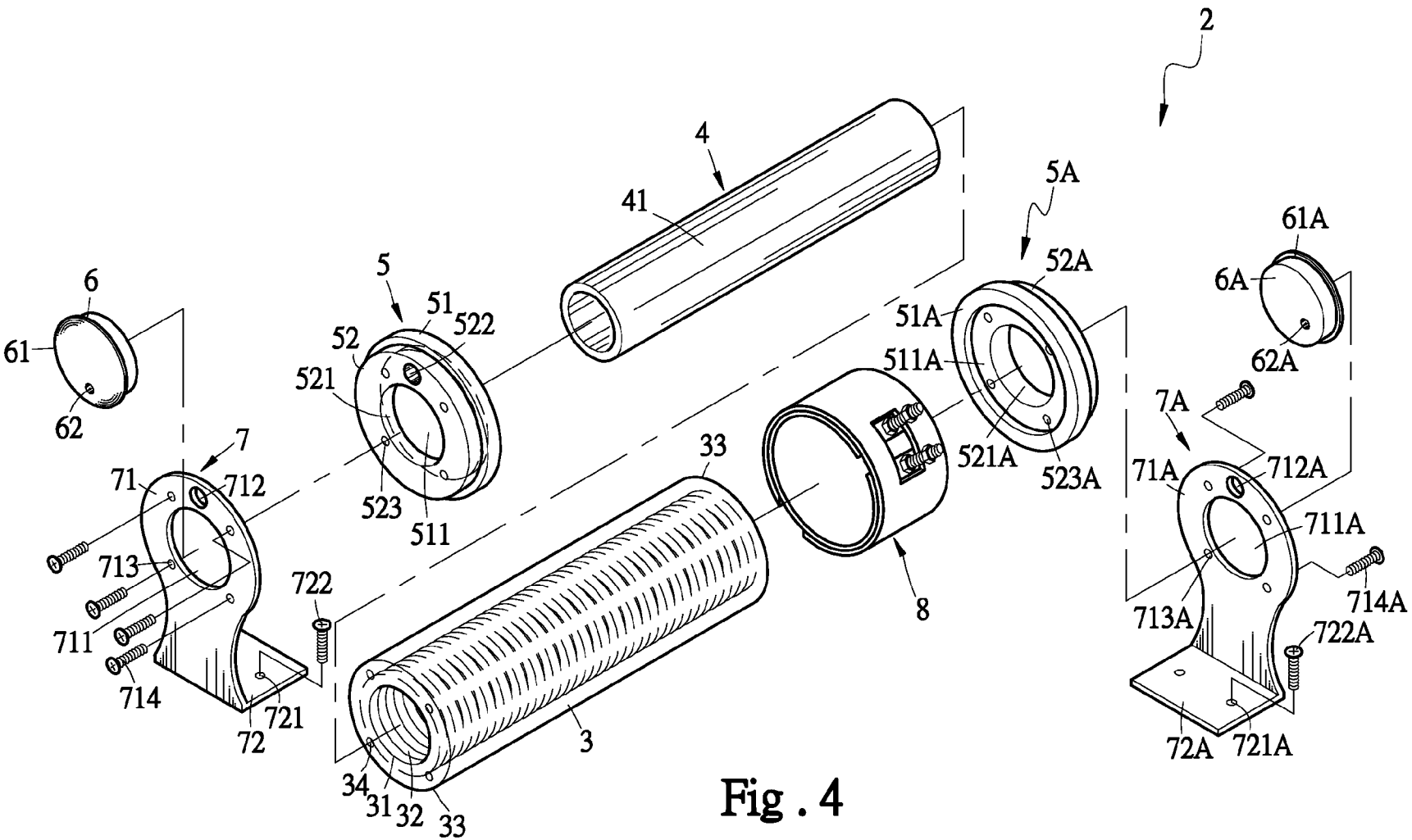
FIG. 4 is an exploded perspective view of the heating apparatus of the present invention.
Figure 5:
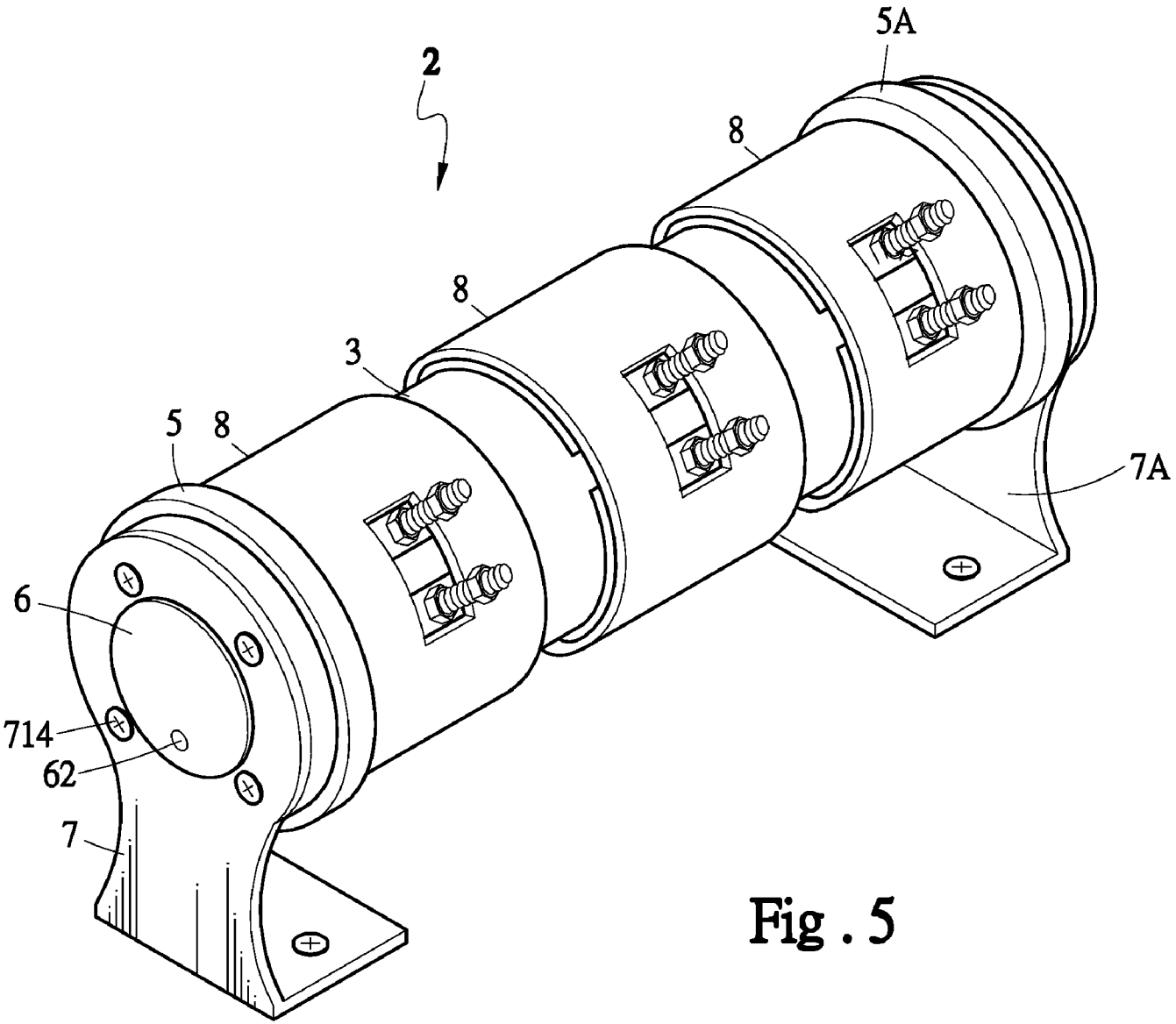
FIG. 5 is a perspective view of the heating apparatus of the present invention.

Please referring to FIGS. 3 through 6, the present invention provides an oil water mixture heating apparatus 2 to heat oil or oil water mixture in an oil water mixture combustion system.

The heating apparatus 2 comprises a metal outer barrel 3, a metal inner barrel 4, a first guide cap 5 and a second guide cap 5A, a first seal cap 6 and a second seal cap 6A, a first holder 7 and a second holder 7A, and an electric heater 8.

The metal outer barrel 3 is made of aluminum alloy and has a first hollow core 31 and a helical trough 32 formed on the inner wall of the metal outer barrel 3 and two side walls 33 with a plurality of fastening holes 34.

The metal inner barrel 4 also is made of the aluminum alloy and held in the first hollow core 31 of the metal outer barrel 3 to form a helical passage 35 with the helical trough 32. The metal inner barrel 4 has a second hollow core 41 inside.

The first guide cap 5 and a second guide cap 5A have respectively a boss opposing each other and are coupled on two sides of the metal inner and outer barrels 4 and 3. The first and second guide caps 5 and 5A have respectively a first side element 51 and 51A with a first and a second recess 511 and 511A formed thereon wedged in by the side walls 33. The first and second guide caps 5 and 5A further have a second side element 52 and 52A on other sides that have respectively a first opening 521 and a second opening 521A communicating with the second hollow core 41 of the metal inner barrel 4. The second side element 52 of the first guide cap 5 has a first aperture 522 communicating with a start end 351 of the helical passage 35 to receive oil or oil water mixture. The other second side element 52A of the second guide cap 5A has a second aperture 522A communicating with a tail end 352 of the helical passage 35 to discharge the oil or oil water mixture (shown by broken lines in FIG. 6). They also have a plurality of first and second fixing holes 523 and 523A formed on the periphery corresponding to the fastening holes 34 of the two side walls 33 of the metal outer barrel 3.

The first seal cap 6 and a second seal cap 6A opposing each other and coupled respectively with the first and second openings 521 and 521A of the first and second guide caps 5 and 5A. The first seal cap 6 and a second seal cap 6A further have respectively a first flange 61 and a second flange 61A on one side, and a first passing hole 62 and a second passing hole 62A communicating with the second hollow core 41 of the metal inner barrel 4.

The first holder 7 and a second holder 7A are formed respectively in a L shape opposing each other. The first and the second holders 7 and 7A include respectively a first upright plate 71 and a second upright plate 71A, and a first transverse plate 72 and a second transverse plate 72A perpendicular to the upright plates 71 and 71A. The first and second upright plates 71 and 71A have respectively a first coupling hole 711 and a second coupling hole 711A to be coupled with the first and second seal caps 6 and 6A, and butted by the first and second flanges 61 and 61A for positioning. The first and second upright plates 71 and 71A also have respectively a first coupling aperture 712 and a second coupling aperture 712A on the periphery mating and communicating with the first and second apertures 522 and 522A to serve as an inlet and an outlet of the oil or oil water mixture (shown by the broken lines in FIG. 6). There are also a plurality of first and second through holes 713 and 713A surrounding the first and second coupling holes 711 and 711A and corresponding to the first and second fixing holes 523 and 523A of the first and second guide caps 5 and 5A to receive first and second fastening elements 714 and 714A such as screws to fasten with the fastening holes 34 of the metal outer barrel 3. The first and second transverse plates 72 and 72A have respectively a plurality of first holes 721 and second holes 721A screwed by first and second anchor elements 722 and 722A to anchor the first and second holders 7 and 7A.

The electric heater 8 encases the metal outer barrel 3. Furthermore, the electric heater 8 includes at least one set according to the length of the metal outer barrel 3.

After the metal inner barrel 4 has been held in the metal outer barrel 3, two sides thereof can be coupled by the first seal cap 6 and second seal cap 6A, and first and second holders 7 and 7A. The metal inner and outer barrel 3 and 4 and the first and second seal cap 6 and 6A are fastened by the fastening elements 714 and 714A such as screws through the first and second through holes 713 and 713A of the first and second holders 7 and 7A, and the first and second fixing holes 523 and 523A of the first and second guide caps 5 and 5A to form a firm positioning on the two side walls 33 of the metal outer barrel 3 through the fastening holes 34. Thus the heating apparatus 2 can be securely installed on a desired location in the oil water mixture combustion system through the first and second holders 7 and 7A.

Figure 6:
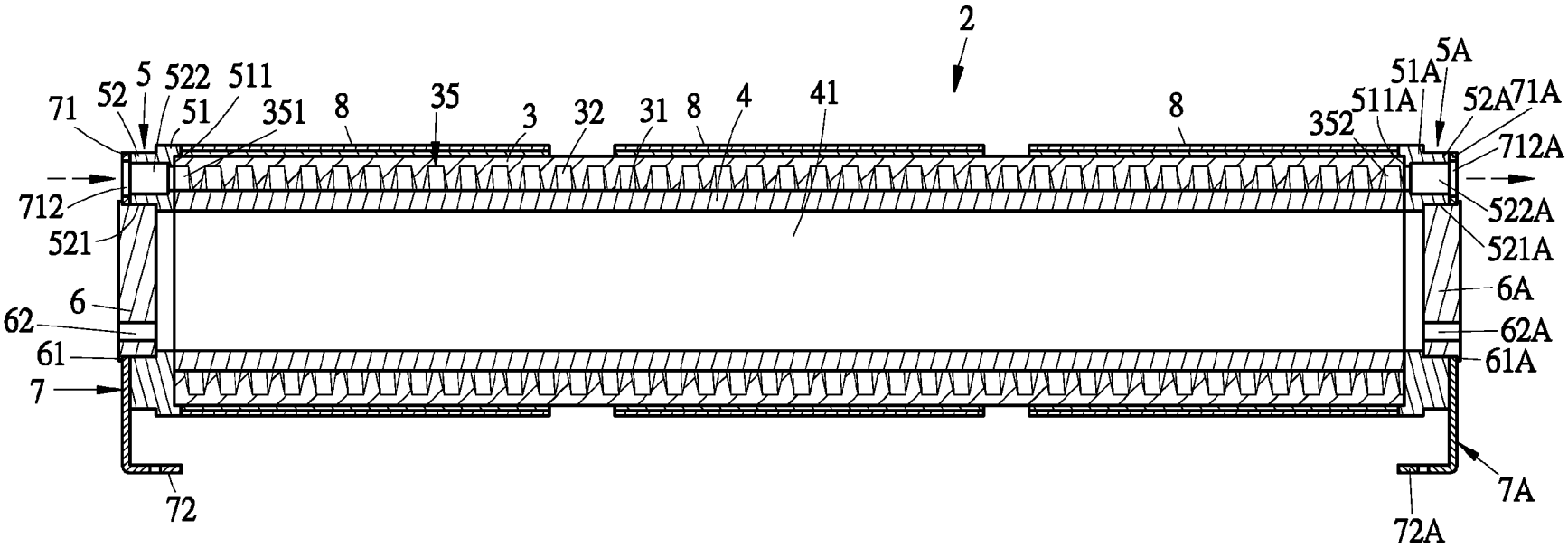
FIG. 6 is a cross sectional view of the present invention showing oil or oil water mixture flowing through the helical passage between the metal inner and outer barrels.

When in use, referring to FIG. 6, oil (diesel oil is taken as an example in this embodiment) or oil water mixture is fed through the first aperture 522 of the first guide cap 5 at one side of the metal inner and outer barrels 4 and 3, the diesel oil or oil water mixture enters the helical passage 35 between the metal inner and outer barrels 4 and 3 can be quickly heated to a combustible temperature at about ninety degrees Celsius, and the heated oil or oil water mixture is discharged through the second aperture 522A of the second guide cap 5A at another side at a steady temperature for combustion to save electric power, since the metal outer barrel 3 is encased by the electric heater 8, and the metal inner and outer barrels 4 and 3 are made of aluminum alloy which can transfer heat rapidly. Moreover, the oil water mixture is rapidly heated and mixed and thrust constantly while forming surface contact with the metal outer barrel 3 and electric heater 8 to form a finer mixture, therefore heating can be accelerated and more electric power saving can be accomplished. Thus it can save energy and realize more economic value.

Figure 7:
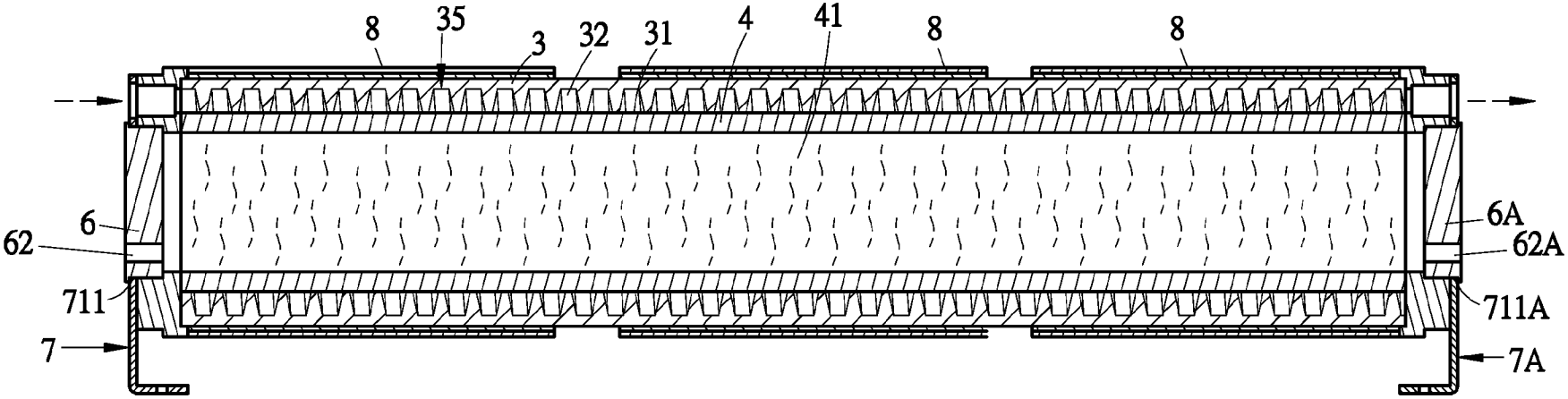
FIG. 7 is a cross sectional view of another embodiment of the present invention to get input and output of hot exhaust gas or heated water or vapor after combustion to perform internal and external heating.

Refer to FIG. 7 for another embodiment of the present invention. The first and second passing holes 62 and 62A of the first and second seal caps 6 and 6A that are coupled with the first and second coupling holes 711 and 711A of the first and second holders 7 and 7A at two opposing sides communicate with the hollow cores 41 and 31 of the metal inner and outer barrels 4 and 3. High temperature heated exhaust gas or hot water or vapor generated after combustion of the oil water mixture enters the hollow core 41 through the first passing hole 62 of the first seal cap 6 to heat the metal inner barrel 4, and flows out through the second passing hole 62A of the second seal cap 6A. Thus the diesel oil or oil water mixture flowing through the helical passage 35 between the metal inner and outer barrels 4 and 3 can be heated at the same time by the electric heater 8 and the high temperature metal outer barrel 3 to accelerate heating and reduce electric power consumption of the electric heater 8.

What is claimed is:

1. An oil water mixture heating apparatus to heat combustion oil or oil water mixture, comprising:

a metal outer barrel which contains a helical trough on an inner wall thereof and a heat receiving surface on an outer wall thereof;

a metal inner barrel coupled in the metal outer barrel to form a helical passage with the helical trough;

an electric heater which is located relatively to and coupled on the outer wall of the metal outer barrel to contact the heat receiving surface of the metal outer barrel;

a first guide cap and a second guide cap that include respectively a first recess and a second recess facing the metal outer barrel and coupling on two side walls of the metal outer barrel, the first recess and the second recess including respectively a first opening and a second opening communicating with the metal inner barrel, and a first a aperture and a second aperture communicating with the helical passage, the first aperture receiving the oil or oil water mixture and the second aperture discharging the oil or oil water mixture a first holder and a second holder that include respectively a first coupling hole and a second coupling hole corresponding to the first opening and the second opening and communicating with the metal inner barrel, and a first coupling aperture and a second coupling aperture corresponding to the first aperture and the second aperture and communicating with the helical passage; and a first seal cap and a second seal cap that are respectively coupled with the first opening of the first guide cap and the second opening of the second guide cap, and the first coupling hole of the first holder and the second coupling hole of the second holder.

2. The oil water mixture heating apparatus of claim 1, wherein the metal outer barrel and the metal inner barrel are made of aluminum alloy.

3. The oil water mixture heating apparatus of claim 2, wherein the metal outer barrel and the metal inner barrel contain respectively a hollow core, the metal outer barrel containing two side walls which include a plurality of fastening holes.

4. The oil water mixture heating apparatus of claim 3, wherein the first holder and the second holder include respectively a first upright plate and a second upright plate, and a first transverse plate and a second transverse plate that are perpendicular to the first and second upright plates; the first and second upright plates containing respectively a first coupling hole and a second coupling hole coupling with the first and second seal caps, and a plurality of first passing holes and second through holes surrounding the first coupling hole and the second coupling hole corresponding to the first and second fixing holes of the first and second guide caps to receive first fastening elements and second fastening elements for fastening, the first and second transverse plates containing a plurality of first holes and second holes to receive a plurality of first anchor elements and second anchor elements for anchoring.

5. The oil water mixture heating apparatus of claim 3, wherein the first seal cap and the second seal cap include respectively a first flange and a second flange at one side and a first passing hole and a second passing hole communicating with the hollow core of the metal inner barrel.

6. The oil water mixture heating apparatus of claim 1, wherein the electric heater includes at least one set according to the length of the metal outer barrel.

* * * * *